US007021868B1

(12) United States Patent
Farrag et al.

(10) Patent No.: US 7,021,868 B1
(45) Date of Patent: Apr. 4, 2006

(54) LIGHTWEIGHT SHORING SYSTEM FOR ACCOMMODATING CROSSING UTILITIES

(75) Inventors: Khalid A. Farrag, Streamwood, IL (US); Alicia M. Farag, Arlington Heights, IL (US)

(73) Assignee: Operations Technology Development NFP, Des Plaines, IL (US)

( * ) Notice: Subject to any disclaimer, the term of this patent is extended or adjusted under 35 U.S.C. 154(b) by 0 days.

(21) Appl. No.: 11/037,599

(22) Filed: Jan. 18, 2005

(51) Int. Cl.
*E02D 17/00* (2006.01)
*E02D 5/00* (2006.01)

(52) U.S. Cl. ..... 405/283; 405/272; 405/282; 160/213

(58) Field of Classification Search ..... 405/272, 405/273, 280, 282, 283; 160/213, 233; 52/65
See application file for complete search history.

(56) References Cited

U.S. PATENT DOCUMENTS

| | | | | | |
|---|---|---|---|---|---|
| 1,907,053 | A | * | 5/1933 | Flath | 405/273 |
| 2,976,923 | A | * | 3/1961 | Hirashiki | 160/236 |
| 3,596,701 | A | * | 8/1971 | Cowan | 160/135 |
| 3,755,982 | A | * | 9/1973 | Scgnudt | 52/295 |
| RE30,185 | E | | 1/1980 | Griswold | |
| 4,685,837 | A | * | 8/1987 | Cicanese | 405/282 |
| 4,707,962 | A | * | 11/1987 | Meheen | 405/273 |
| 5,199,824 | A | | 4/1993 | Smith et al. | |
| 5,209,606 | A | | 5/1993 | Plank | |
| 5,232,312 | A | | 8/1993 | Jennings et al. | |
| 5,302,054 | A | | 4/1994 | Winkler et al. | |
| 5,310,290 | A | | 5/1994 | Spencer | |
| 5,319,905 | A | * | 6/1994 | Szirtes | 160/213 |
| 5,527,137 | A | | 6/1996 | Spencer | |
| 5,669,738 | A | | 9/1997 | Kundel | |
| 6,224,296 | B1 | | 5/2001 | Fukumori | |
| 6,443,665 | B1 | | 9/2002 | Kundel, Sr. | |
| 6,675,538 | B1 | * | 1/2004 | Candio | 52/65 |
| 2005/0042038 | A1 | * | 2/2005 | Irvine | 405/276 |

FOREIGN PATENT DOCUMENTS

| | | | | |
|---|---|---|---|---|
| WO | 9421863 | * | 9/1994 | 405/274 |

* cited by examiner

*Primary Examiner*—Jong-Suk (James) Lee
(74) *Attorney, Agent, or Firm*—Mark E. Fejer

(57) ABSTRACT

An excavation shoring system having four vertical, cylindrical poles, each connected to a base element, arranged to constitute corners of a rectangle. At least one vertically oriented shoring panel corresponding to each side of the rectangle is provided, with each of the shoring panels corresponding to adjacent sides of the rectangle having one end rotatably connected to a first pair of diagonally opposed cylindrical poles in a manner forming four vertical walls of uniform height. At least two vertically oriented, U-shaped channels disposed at right angles to each other are connected to a second pair of diagonally opposed cylindrical poles. The U-shaped channels have a channel width substantially corresponding to a thickness of the panels and are oriented to receive a free end of each shoring panel.

14 Claims, 11 Drawing Sheets

LIGHTWEIGHT SHORING SYSTEM FOR ACCOMMODATING CROSSING UTILITIES

BACKGROUND OF THE INVENTION

1. Field of the Invention

This invention relates to excavation shielding and shoring systems generally comprising vertical support elements and multiple vertically positioned wall shoring panels for shoring up the walls of an excavation and to a method for shoring excavations. More particularly, this invention relates to excavation shielding and shoring systems for excavations having structures crossing through the excavation, such as utility pipelines and the like, which are installable from outside of the excavation and which are able to accommodate the crossing structures.

2. Description of Related Art

Occupational Safety and Health Administration (OSHA) regulations require that any excavation over five feet deep be properly shielded or shored to prevent cave-ins or to protect workers inside an excavation in the event of a cave-in. Trench shielding is used to protect workers from cave-ins or landslides while allowing for normal shifts and fissures of the trench face. By comparison, trench shoring is used to prevent any movement of the trench face so as not to damage nearby structures, such as building foundations and roadways.

Trench boxes, hydraulic shoring, and timber shoring are standard methods used to comply with the OSHA regulations in utility excavations. However, although these systems can provide the required support, they do not always provide the flexibility required to fit around crossing utilities and other obstacles inside the excavation. Trench boxes are large steel or aluminum boxes that are typically assembled above ground by workers at the job site and dropped inside utility trenches. However, if utility lines running perpendicular to the trench are also present, the trench boxes cannot be dropped around these crossing lines. Similarly, hydraulic shoring also is not designed to fit around crossing utility lines, especially when used in conjunction with prefabricated facing panels. By way of comparison, timber shoring is flexible enough to fit around obstructions; however, its construction is performed while the workers are inside the excavation, thereby potentially exposing the workers to unsafe conditions.

There are in existence a wide variety of excavation protective structures and shoring systems. By way of example, reissued U.S. Pat. No. Re. 30,185 to Griswold teaches a trench shoring system assembly which includes a pair of spaced apart side walls for vertical disposition within a trench interconnected by spreader pipes and collars which allow limited pivotal movement between the side walls. Similarly, U.S. Pat. No. 5,310,290 to Spencer teaches a protective structure for excavations comprising a protective panel which may be used alone or paired to provide a protective space in an excavation by buttressing the upright walls of the excavation. U.S. Pat. No. 5,302,054 teaches an excavation shoring system utilizing a plurality of shoring panels positioned between adjacent vertical soldier beams around the periphery of an excavation hole. However, none of these known systems is able to accommodate utility lines or other crossing structures passing through or running perpendicular to the trench.

SUMMARY OF THE INVENTION

Accordingly, it is one object of this invention to provide an excavation shoring system suitable for use in excavations through which structures such as utility pipelines are crossing.

It is another object of this invention to provide an excavation shoring system which can be assembled in the excavation from above ground.

It is yet another object of this invention to provide a relatively lightweight excavation shoring system.

These and other objects of this invention are addressed by a modular shoring system which utilizes hinged panels that can be maneuvered around crossing utility lines and other crossing structures while being lowered into the excavation by a person standing outside of the excavation. More particularly, the shoring system of this invention comprises four vertical, cylindrical poles arranged to constitute the four corners of a rectangle having a base element connected to a lower end of each pole. At least one vertically oriented shoring panel corresponding to each side of the rectangle is provided. The shoring panels corresponding to adjacent sides of the rectangle have one end rotatably connected to a first pair of diagonally opposed said poles in a manner forming four vertical walls of uniform height and an opposite movable end. Securement means are provided for securing the opposite movable ends of the shoring panels to a second pair of diagonally opposed said poles. In accordance with one preferred embodiment, at least two vertically oriented, U-shaped channels disposed at right angles to each other are rotatably connected to the second pair of diagonally opposed said poles. The U-shaped channels have a channel width substantially corresponding to a thickness of said panels and oriented to receive the movable end of each shoring panel.

BRIEF DESCRIPTION OF THE DRAWINGS

These and other objects and features of this invention will be better understood from the following detailed description taken in conjunction with the drawings wherein.

DETAILED DESCRIPTION OF THE PRESENTLY PREFERRED EMBODIMENTS

The invention described herein is a system for protecting workers from cave-ins or landslides while working in an excavation. Although described herein as a shoring system, it is to be understood that the system may also be employed as a shielding system, and such uses are deemed to be within the scope of this invention. In addition, the shoring system of this invention, while particularly suited for use in excavations having crossing utilities or other crossing structures, is also suitable for use in excavations in which no crossing utilities or other crossing structures are present, and such uses are also deemed to be within the scope of this invention.

Figure 1:
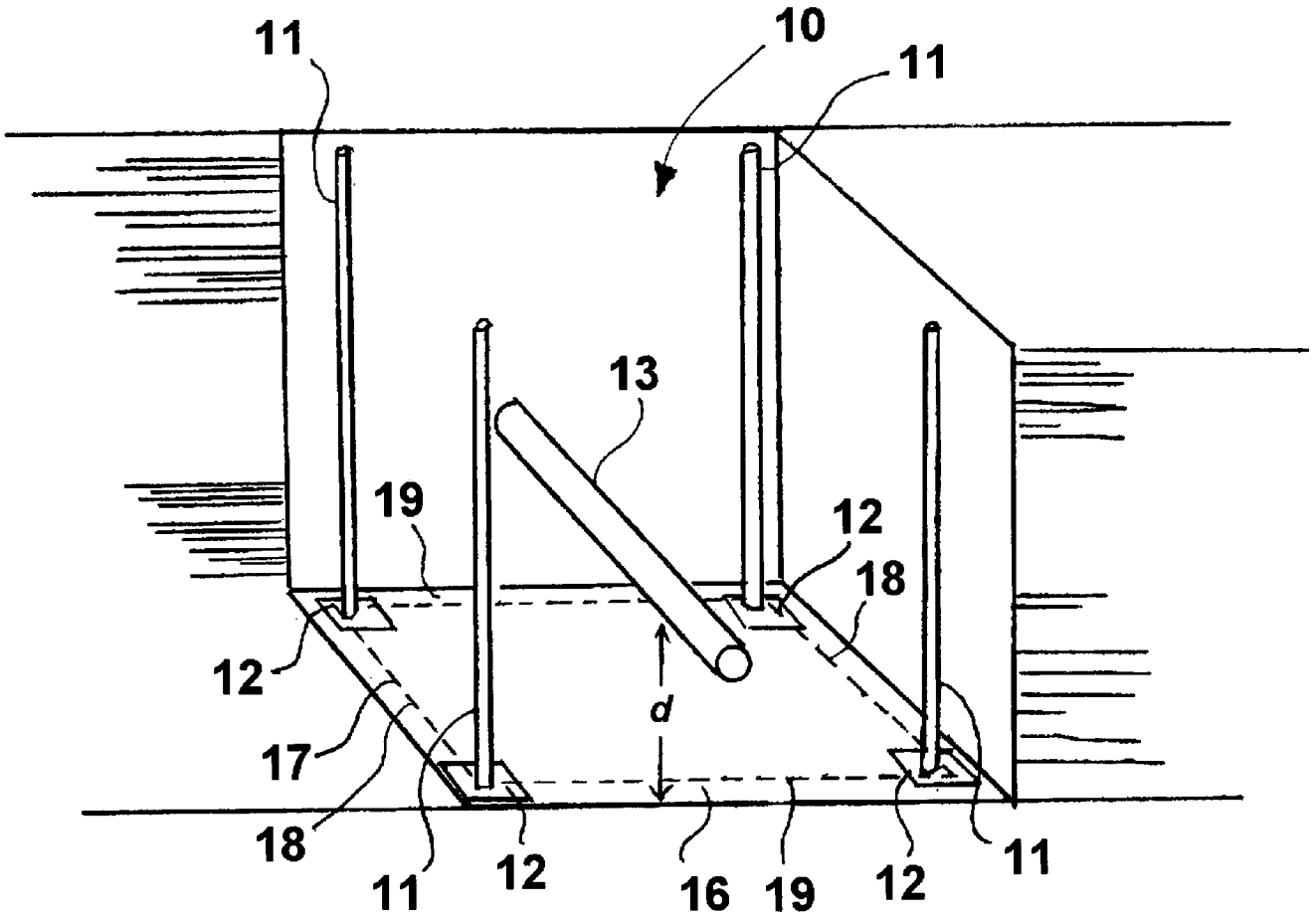
FIG. 1 shows the disposition of vertical, cylindrical poles in accordance with one embodiment of this invention in an excavation through which a utility pipeline is crossing.

The initial step in the assembly of the shoring system of this invention is the installation in the excavation 10 of four vertical, cylindrical poles 11, each of which has a base element 12 connected to its lower end as shown in FIG. 1. The excavation shown in FIG. 1 includes a crossing pipeline 13 disposed at a distance d from the bottom 16 of the excavation 10. Also as shown in FIG. 1, cylindrical poles 11 are disposed within the excavation 10 so as to constitute the four corners of a rectangle identified by dotted line 17, which rectangle has two sides 18 oriented parallel to the direction of crossing of crossing pipeline 13 and two sides 19 oriented perpendicular to the direction of crossing of crossing pipeline 13.

Figure 2:
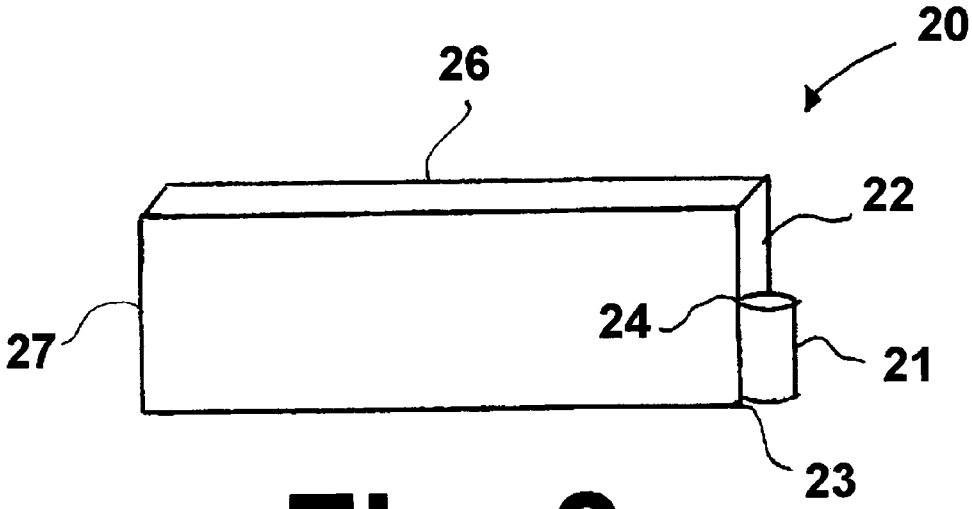
FIG. 2 is a diagram showing a first type of shoring panel employed in accordance with one embodiment of the shoring system of this invention.
Figure 6:
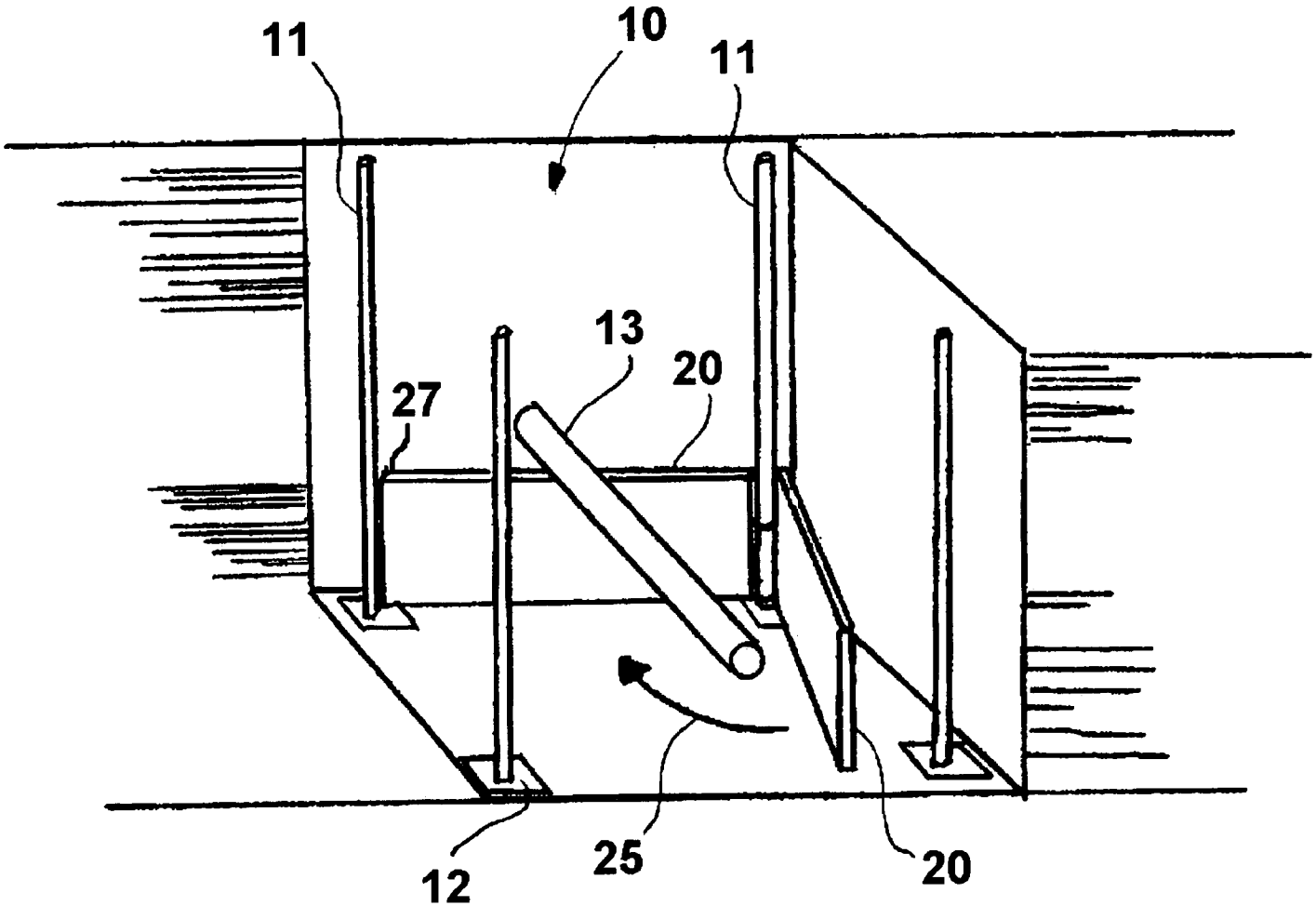
FIG. 6 is a diagram showing installation of a shoring panel of the type shown in FIG. 2 in accordance with one embodiment of this invention.

After installation of the four vertical, cylindrical poles 11, a first vertically oriented shoring panel 20, as shown in FIG. 2, having a vertical height less than the distance d between the crossing pipeline 13 and the bottom 16 of the excavation 10 is connected to one of the cylindrical poles 11 in a manner which permits the rotation of the shoring panel around the cylindrical pole as shown in FIG. 6. Shoring panel 20, as shown in FIG. 2, comprises a substantially rectangular shoring panel wall 26 having a rotatable end 22 and an opposite movable end 27. Initial installation of shoring panel 20 is in a direction along a side 18 of rectangle 17 substantially parallel to the direction of crossing of crossing pipeline 13. Once connected to cylindrical pole 11, shoring panel 20 is rotated around cylindrical pole 11 as indicated by arrow 25 and beneath crossing pipeline 13 resulting in an orientation along a side 19 of rectangle 17 substantially perpendicular to the direction of crossing of the crossing pipeline. It will be apparent to those skilled in the art that there are numerous means by which shoring panel 20 can be rotatably connected to cylindrical pole 11 and all such means are deemed to be within the scope of this invention. In accordance with one particularly preferred embodiment of this invention, as shown in FIG. 2, a hollow cylinder 21 is connected to rotatable end 22 of shoring panel wall 26. Hollow cylinder 21 has a length corresponding to about ½ the vertical height of said rotatable end 22 and has an inside diameter corresponding to the outside diameter of cylindrical poles 11, thereby enabling hollow cylinder 21 to fit coaxially around cylindrical poles 11, enabling shoring panel 20 to be lowered down into the excavation, and enabling shoring panel 20 to be rotated around cylindrical pole 11. As shown in FIG. 2, hollow cylinder 21 extends from a corner 23 to about a midpoint 24 of said rotatable end 22 of shoring panel wall 26.

Figure 7:
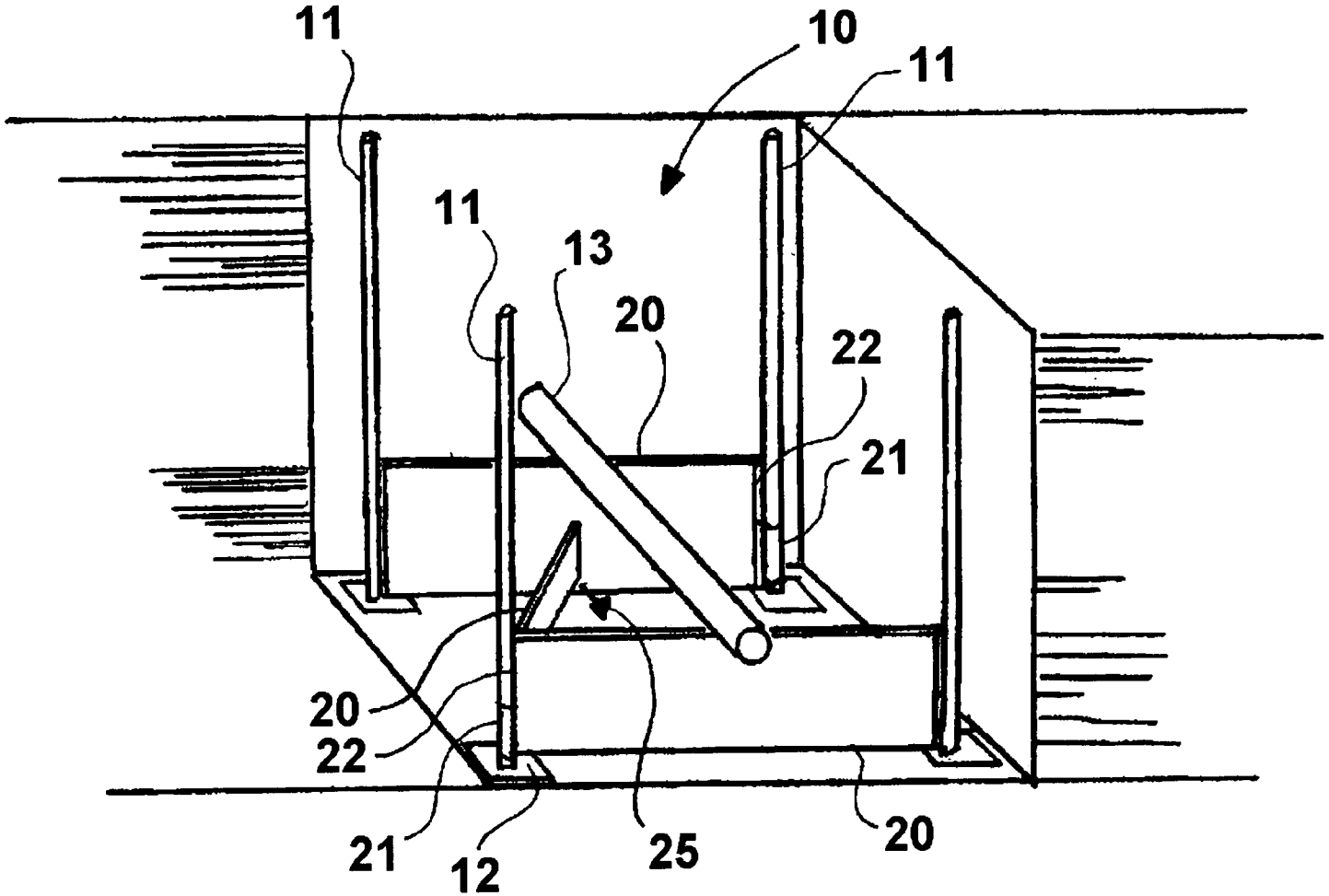
FIG. 7 is a diagram showing installation of a second shoring panel of the type shown in FIG. 2 in accordance with one embodiment of this invention.

After installation of the first shoring panel 20 as described herein above, a second shoring panel 20 is rotatably connected to the cylindrical pole 11 diagonally opposed to the cylindrical pole 11 to which the first shoring panel 20 is connected and rotated beneath crossing pipeline 13 to be substantially parallel to the first shoring panel 20 as shown in FIG. 7. As can be seen in FIGS. 6 and 7, shoring panels 20 are oriented such that hollow cylinder 21 is connected to the lower half of the vertically oriented rotatable ends 22 thereof. Such disposition is necessary in order to complete the installation of the shoring system in accordance with one embodiment of this invention.

Figure 5:
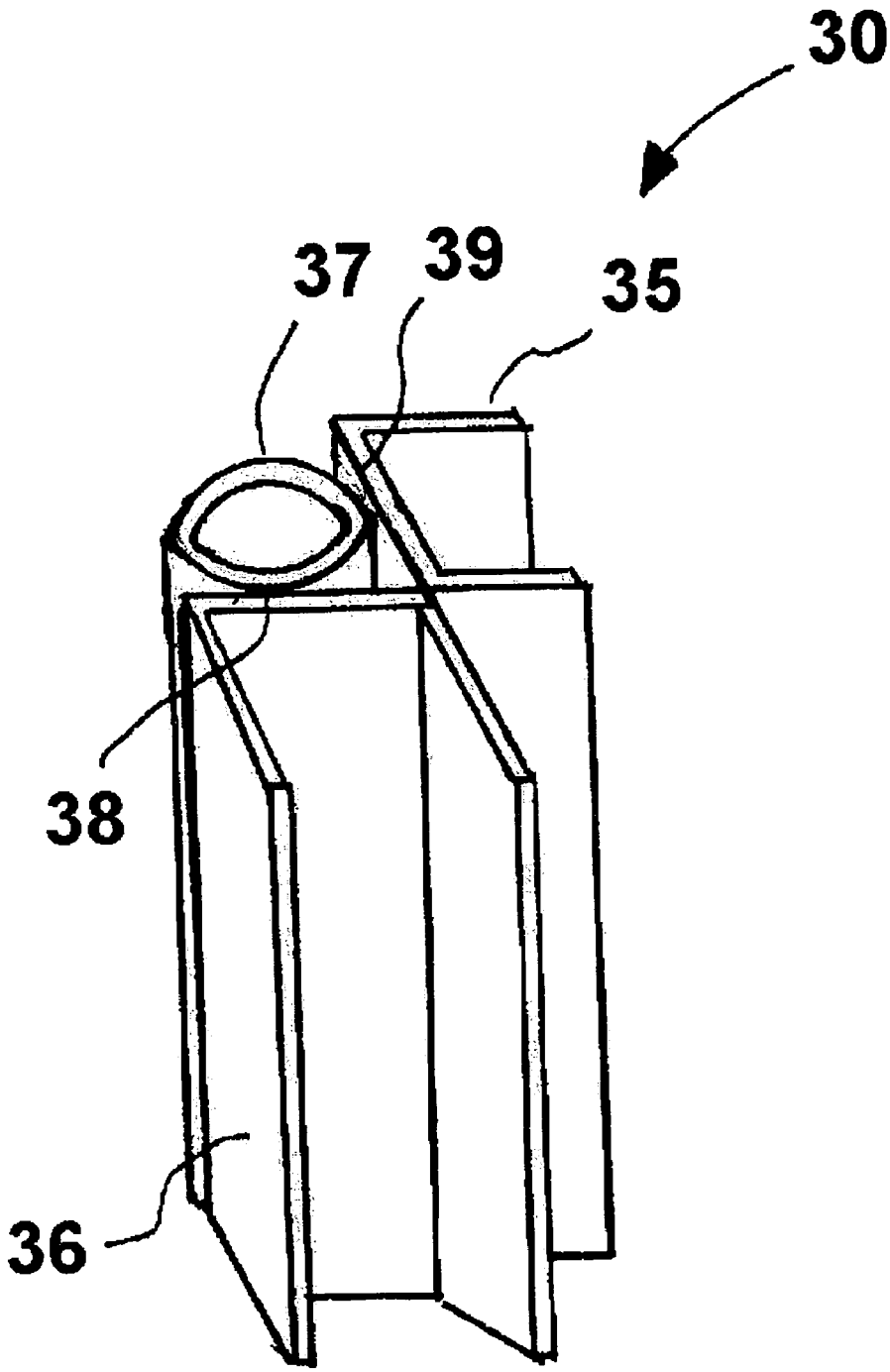
FIG. 5 is a diagram showing a U-shaped channel assembly employed in accordance with one embodiment of this invention.
Figure 8:
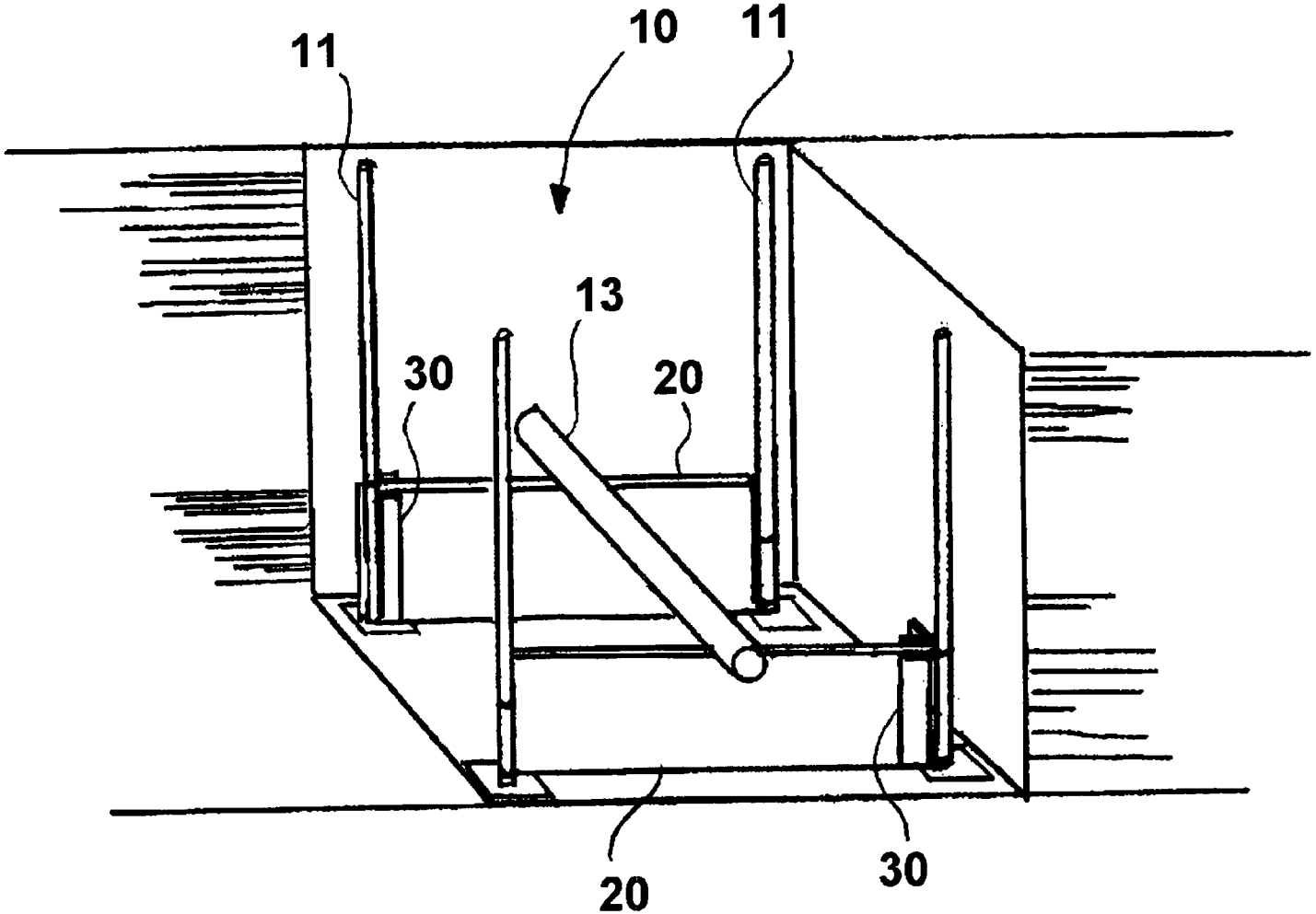
FIG. 8 is a diagram showing the disposition of the U-shaped channel assembly in accordance with one embodiment of the shoring system of this invention.

At this point in the installation, said rotatable end 22 of each shoring panel 20 is rotatably connected to a cylindrical pole 11 and the opposite movable ends 27 are free of any constraints. To secure these opposite movable ends 27 of the shoring panels, securement means are provided for securing the opposite movable ends 27 to the second pair of diagonally opposed cylindrical poles 11. In accordance with one particularly preferred embodiment of this invention, said securement means comprises a pair of U-shaped channels 35, 36 disposed at right angles to each other as shown in FIG. 5 rotatably connected to the diagonally opposed cylindrical poles proximate the movable ends 27 of the shoring panels. In accordance with one particularly preferred embodiment of this invention, the bottoms 39 and 38 of U-shaped channels 35 and 36, respectively, are connected to a hollow cylinder 37, forming a U-shaped channel assembly 30, which hollow cylinder has an inside diameter corresponding to the outside diameter of cylindrical poles 11 and a length corresponding to the vertical height of shoring panels 20. In this manner, hollow cylinder 37 can be lowered over the cylindrical pole 11 into the excavation. Rotation of hollow cylinder 37 around cylindrical pole 11 enables proper alignment of the U-shaped channels 35, 36 with the movable ends of shoring panels 20, thereby enabling the movable ends to be secured within the U-shaped channels and precluding further rotation of the shoring panels, as shown in FIG. 8.

Figure 9:
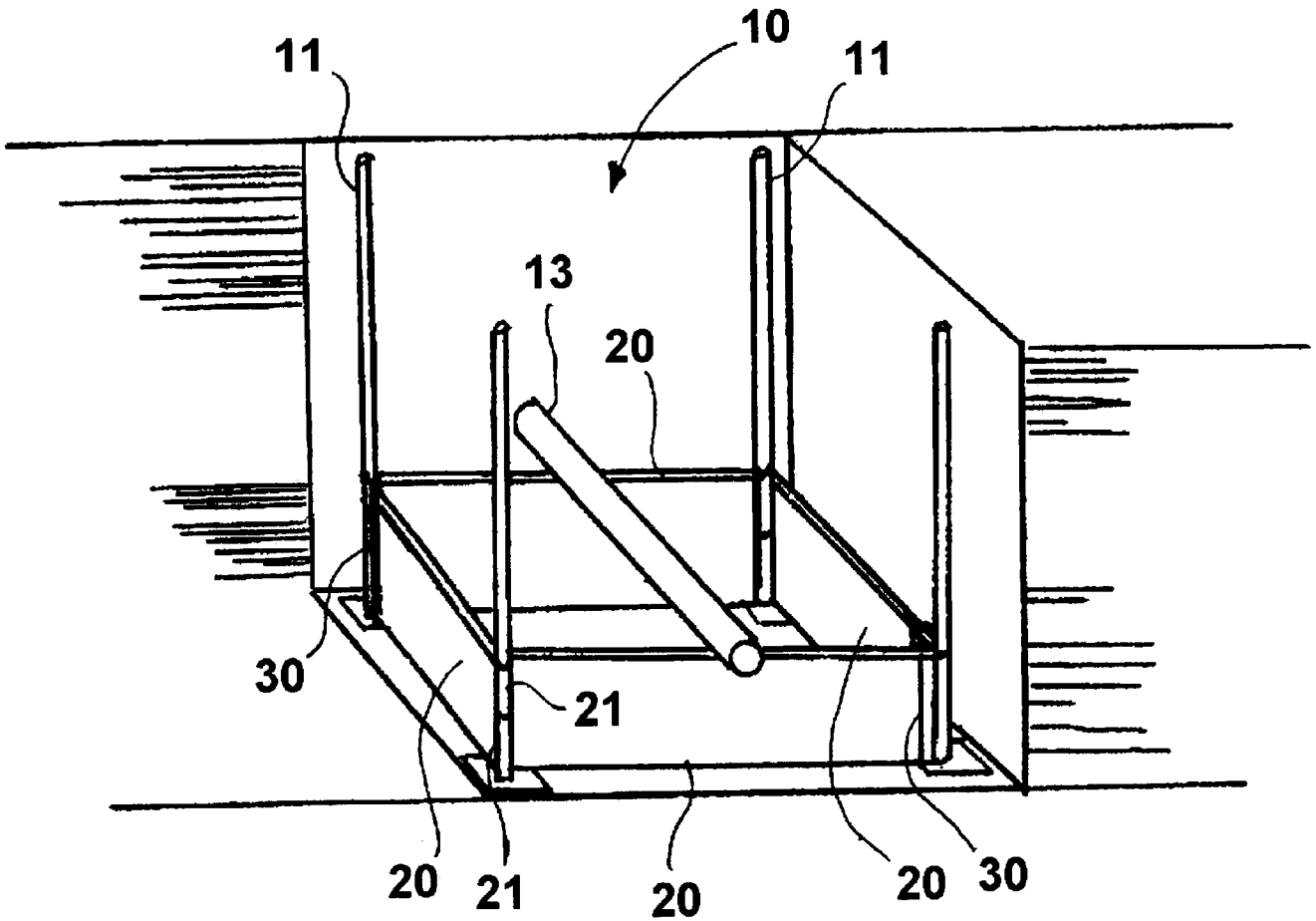
FIG. 9 is a diagram showing a completed first tier of shoring panels in accordance with one embodiment of the shoring system of this invention.

To complete installation of the initial layer of vertical shoring panels as shown in FIG. 9, two additional shoring panels 20 are rotatably connected to the same cylindrical poles 11 to which the first and second shoring panels 20 are rotatably connected. To provide for an initial layer of substantially uniform height, these additional shoring panels 20 are installed such that hollow cylinders 21 are connected to the upper halves of the vertically oriented ends thereof. These additional shoring panels 20 are rotated around cylindrical poles 11 so as to be substantially parallel to the direction of crossing pipeline 13, thereby enabling the free ends of these additional shoring panels to be inserted into the available U-shaped channels.

Although the installation of only a single layer of vertical shoring panels has been described, depending upon the distance d between the crossing pipeline and the bottom of the excavation, additional layers of vertical shoring panels may be installed beneath the crossing pipeline in the same manner as the initial layer as described herein above.

Figure 4:
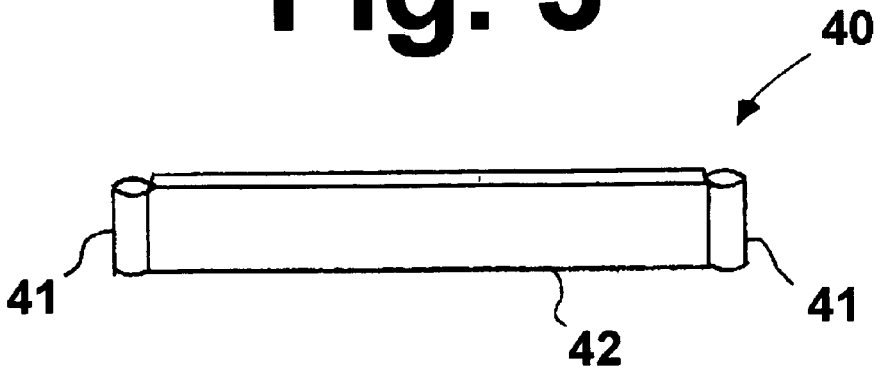
FIG. 4 is a diagram showing a third type of shoring panel employed in accordance with one embodiment of this invention.
Figure 10:
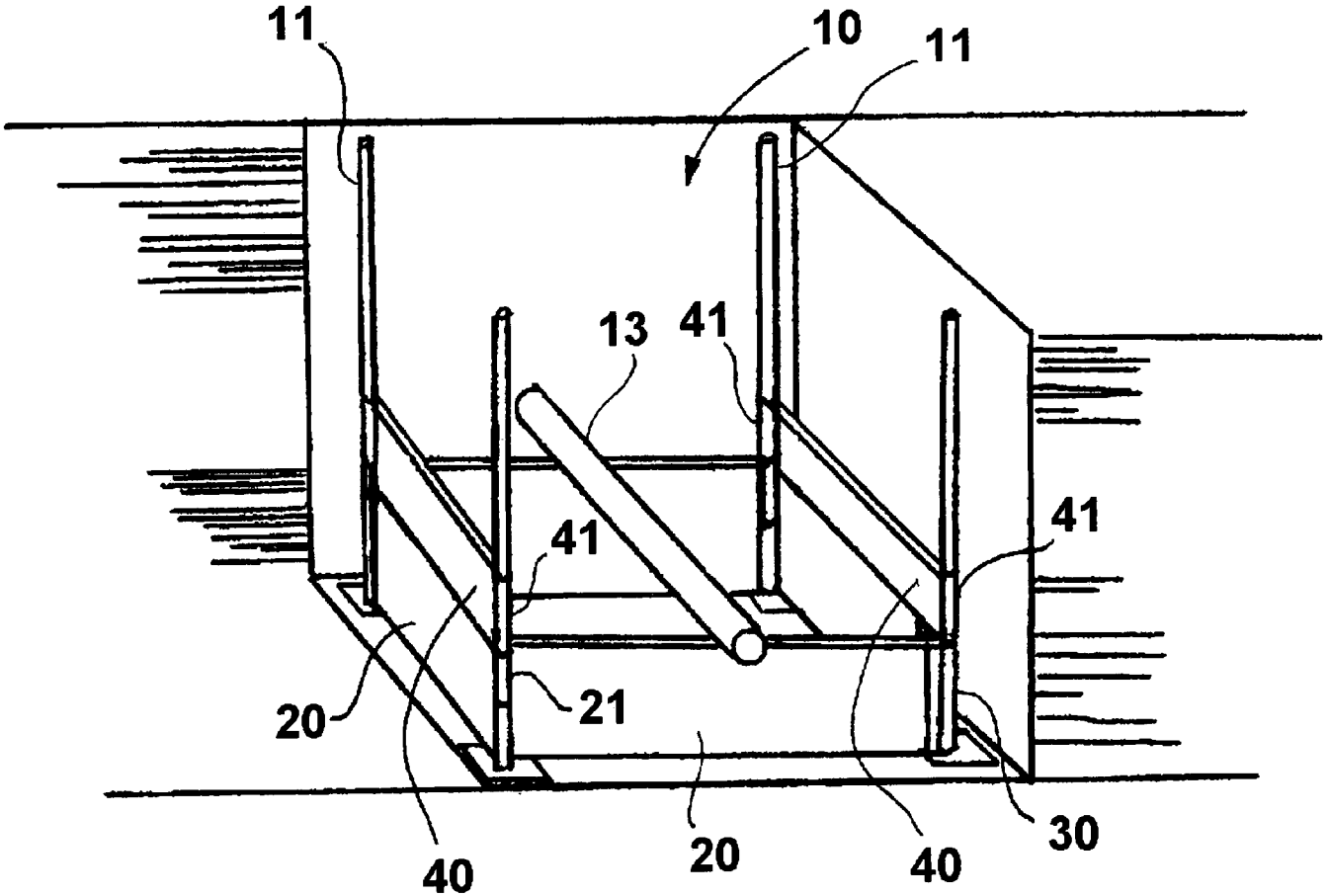
FIG. 10 is a diagram showing installation of shoring panels of the type shown in FIG. 4 in accordance with one embodiment of the shoring system of this invention.

FIG. 4 shows a spacer shoring panel 40 employed in accordance with one embodiment of the shoring system of this invention. Spacer shoring panel 40 comprises a vertically oriented, substantially rectangular spacer panel 42, which has a vertical height greater than the outside diameter of crossing pipeline 13. A hollow cylinder 41 having an inside diameter substantially corresponding to the outside diameter of cylindrical poles 11 and having a length substantially corresponding to the vertical height of spacer panel 42 is connected to each end of spacer panel 42. Spacer shoring panels 40 are installed on sides 18 of rectangle 17 parallel to crossing pipeline 13, as shown in FIG. 10, with each end connected by means of hollow cylinders 41 to one of cylindrical poles 11.

Figure 3:
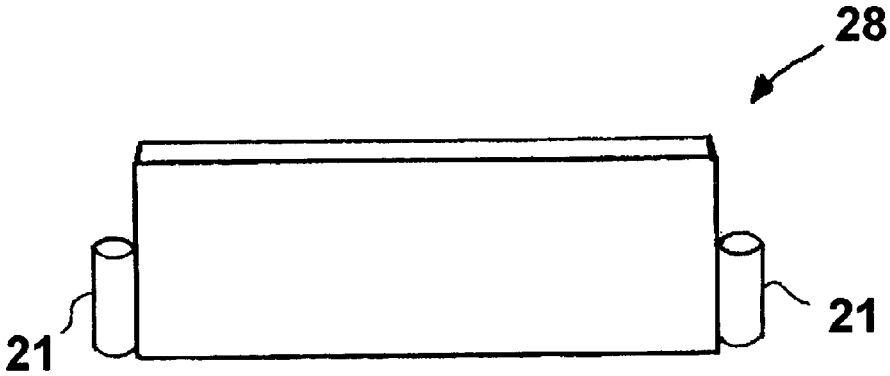
FIG. 3 is a diagram showing a second type of shoring panel employed in accordance with one embodiment of this invention.
Figure 11:
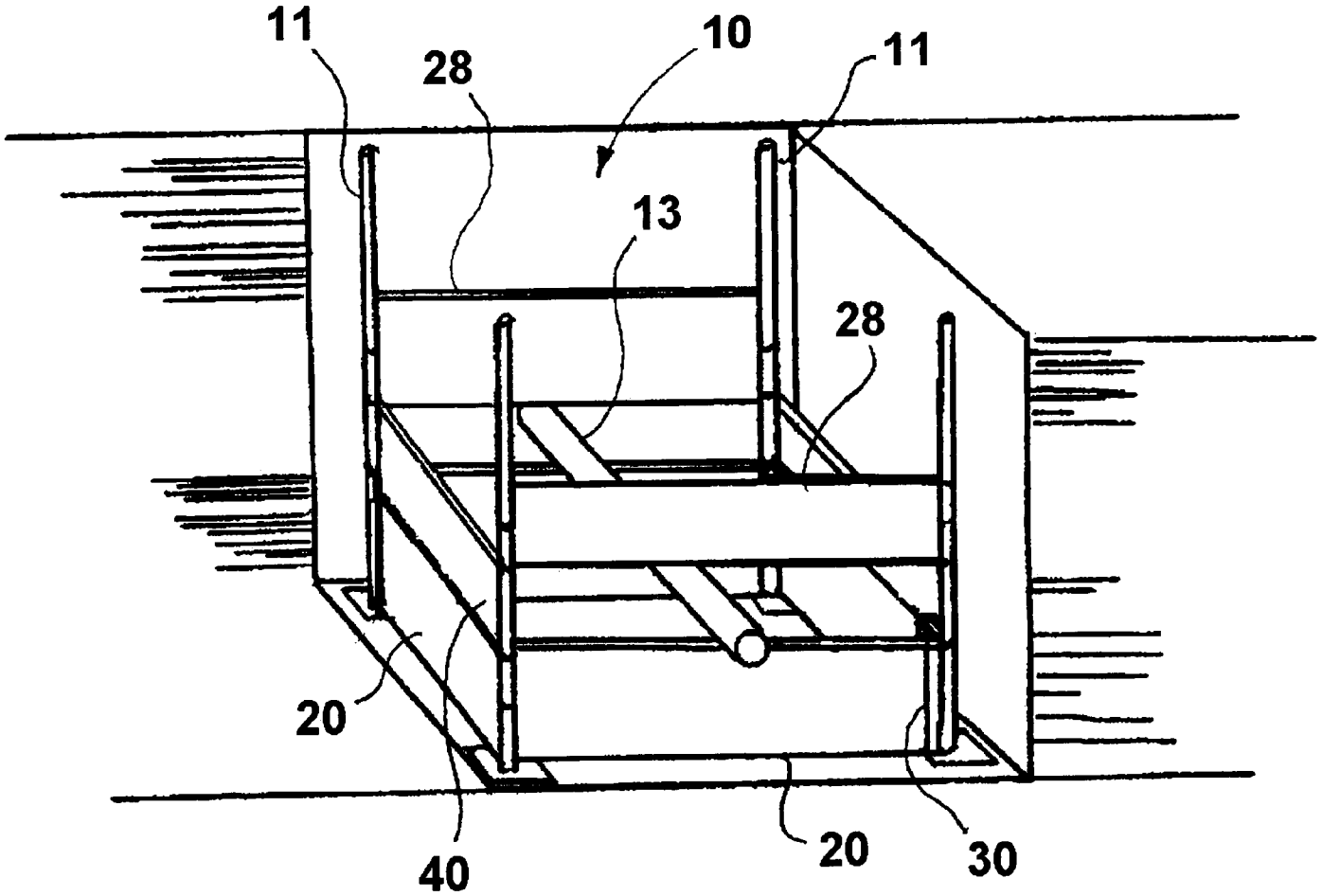
FIG. 11 is a diagram showing installation of shoring panels of the type shown in FIG. 3 in accordance with one embodiment of this invention.
Figure 12:
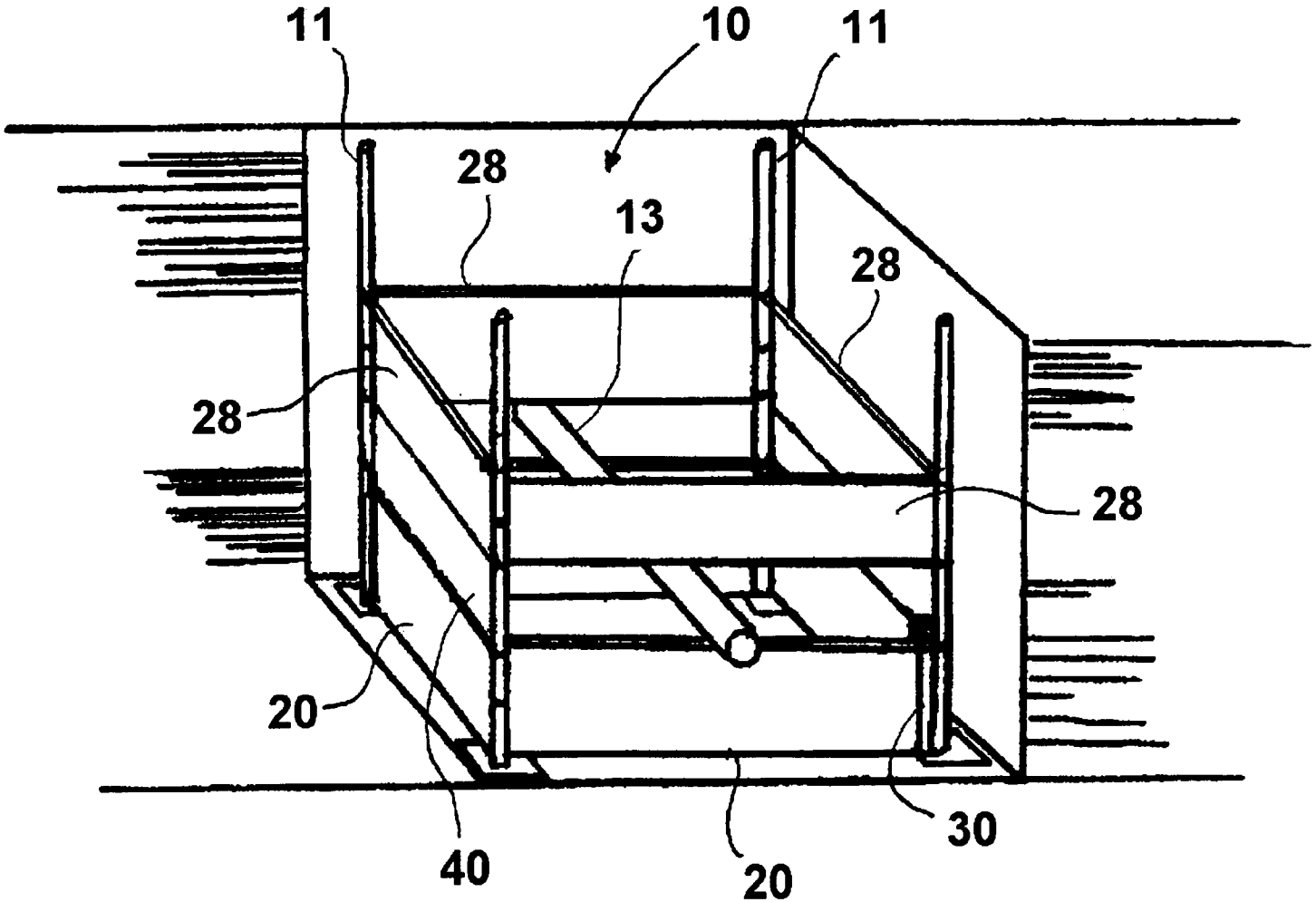
FIG. 12 is a diagram showing a complete shoring system in accordance with one embodiment of this invention.

Completion of the shoring system of this invention is accomplished by the installation of a plurality of vertically oriented shoring panels 28 of the type shown in FIG. 3. Shoring panels 28 are substantially identical to shoring panels 20 shown in FIG. 2 except for the disposition of hollow cylinders 21 connected to both ends of the shoring panel wall. As shown in FIGS. 11 and 12, vertically oriented shoring panels 28 are installed above spacer shoring panels 40 and, accordingly, also above crossing pipeline 13 by connection to the cylindrical poles 11.

As previously indicated, the shoring system of this invention is completely installable from outside the excavation. In accordance with one embodiment of this invention, the shoring panels are equipped with a fixture that allows a hook with a long handle to lower the panels into the excavation. And, because the panels are rotatable around the vertical cylindrical poles, the hooks can be employed to maneuver the panels into place.

Figure 13:
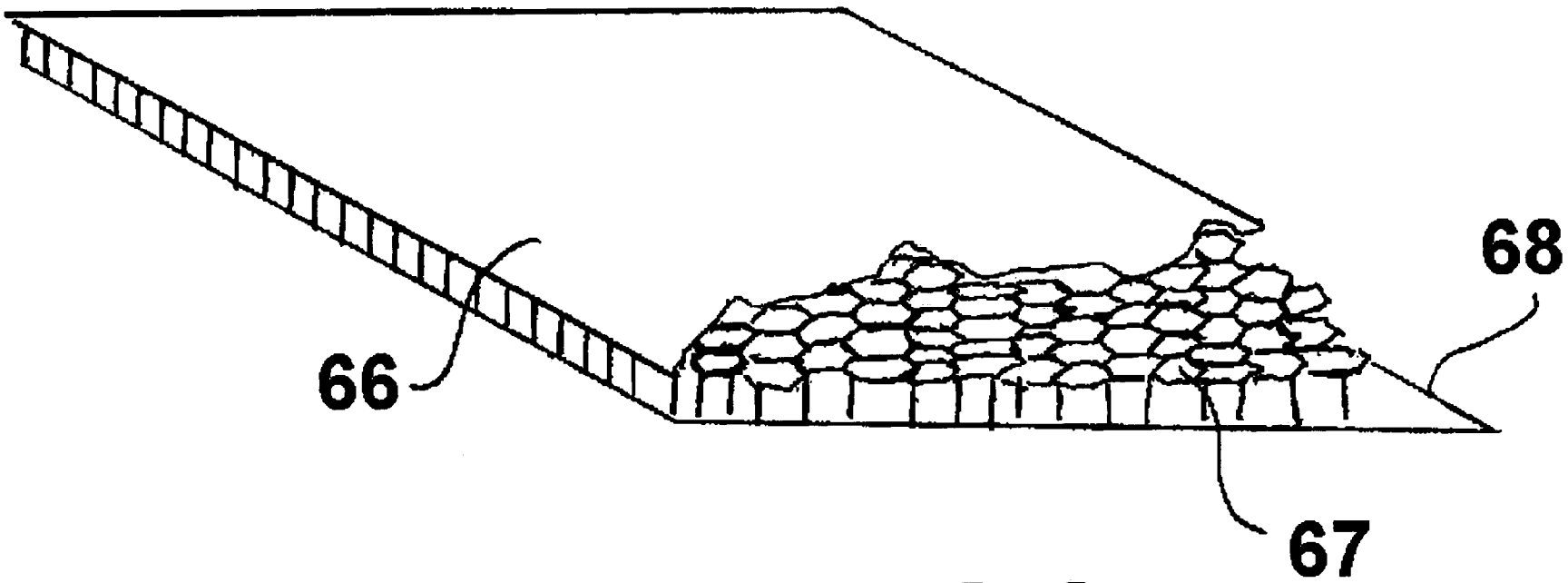
FIG. 13 is a partial cutaway diagram showing the structure of a shoring panel employed in accordance with one embodiment of the shoring system of this invention.

In accordance with one particularly preferred embodiment of this invention, the shoring panels are lightweight, constructed of thin aluminum sheets 66, 68 between which is sandwiched a honeycomb aluminum filling 67 as shown in FIG. 13. The thickness of the panels is designed to provide the required support of lateral earth pressure at the various depths of the excavation. However, any other lightweight panels may be employed provided that the panel section provides the strength required to support earth pressures in accordance with OSHA standards.

While in the foregoing specification this invention has been described in relation to certain preferred embodiments thereof, and many details have been set forth for the purpose of illustration, it will be apparent to those skilled in the art that the invention is susceptible to additional embodiments and that certain of the details described herein can be varied considerably without departing from the basic principles of this invention.

What is claimed is:

1. An excavation shoring system comprising:

four vertical, cylindrical poles arranged to constitute corners of a rectangle;

a base element connected to a lower end of each said pole;

at least one vertically oriented shoring panel corresponding to each side of said rectangle, said shoring panels corresponding to adjacent said sides of said rectangle having one end rotatably connected to a first pair of diagonally opposed said poles, said shoring panels oriented to form four vertical walls of uniform height of said rectangle and said shoring panels having an opposite movable end; and securement means for securing said opposite movable end of each said shoring panel to a second pair of diagonally opposed said poles, said securement means comprising at least two vertically oriented, U-shaped channel assemblies comprising two U-shaped channels disposed at right angles to each other connected to said second pair of diagonally opposed said poles, said U-shaped channels having a channel width substantially corresponding to a thickness of said shoring panels and oriented to receive said opposite movable end of each said shoring panel.

2. An excavation shoring system in accordance with claim 1, wherein said shoring panel comprises a hollow cylindrical element having an inside diameter corresponding to an outside diameter of said cylindrical poles concentrically disposed around said cylindrical poles, said hollow cylindrical element connected to said one end of said shoring panel and extending along said one end from a corner of said shoring panel to about a midpoint of a length of said one end.

3. An excavation shoring system in accordance with claim 2 further comprising a plurality of vertically oriented additional shoring panels having one of said hollow cylindrical elements connected at each end of said additional shoring panels and extending along each said end from said corner of said panel to about said midpoint of said length of each said end.

4. An excavation shoring system in accordance with claim 1, wherein said shoring panels are constructed of a substantially planar honeycomb structure sandwiched between two substantially planar, solid layers of a material suitable for use in an excavation shoring.

5. In a substantially rectangular excavation having at least one excavation crossing structure disposed at a distance from a bottom of said excavation, a method for shoring up said excavation comprising the steps of:

placing a vertically oriented cylindrical pole having a base element connected to a lower end of said pole in each corner of said substantially rectangular excavation;

connecting a first substantially rectangular shoring panel in a vertical orientation and substantially parallel to said crossing structure to said lower end of a first said cylindrical pole and rotating said shoring panel in a horizontal direction around said cylindrical pole and beneath said crossing structure to align with a second said cylindrical pole disposed on a same side of said rectangular excavation as said first cylindrical pole and on an opposite side of said crossing structure;

connecting a second substantially rectangular shoring panel substantially identical to said first substantially rectangular shoring panel in said vertical orientation to said lower end of a third said cylindrical pole, said third said cylindrical pole diagonally disposed from said first cylindrical pole, and rotating said second substantially rectangular shoring panel in said horizontal direction around said third said cylindrical pole and beneath said crossing structure to a direction substantially parallel to said first substantially rectangular shoring panel;

connecting a third substantially rectangular shoring panel in said vertical orientation to said first cylindrical pole in a direction perpendicular to said first and second substantially rectangular panels;

connecting a fourth substantially rectangular shoring panel in said vertical orientation to said third cylindrical pole in said direction perpendicular to said first and second substantially rectangular panels; and securing a movable end of each of said rectangular shoring panels to one of said second cylindrical pole and a fourth cylindrical pole, thereby forming a first tier of a shoring box.

6. A method in accordance with claim 5, wherein said movable ends are secured by connecting two vertically oriented U-shaped channels disposed at right angles to each other to said lower end of each of said second cylindrical pole and said fourth cylindrical pole, said U-shaped channels having a width substantially corresponding to a thickness of said panels and oriented toward said first and said third cylindrical poles, and inserting said movable ends into a corresponding said U-shaped channel.

7. A method in accordance with claim 5 further comprising connecting two substantially rectangular spacer shoring panels in said vertical orientation and said direction parallel to said crossing structure to said first and second cylindrical poles and to said third and fourth cylindrical poles, respectfully, said spacer shoring panels having a vertical dimension greater than a crossing structure vertical dimension.

8. A method in accordance with claim 7 further comprising connecting at least one upper excavation substantially rectangular shoring panel in said vertical orientation to each of said first and second cylindrical poles, said second and third cylindrical poles, said third and fourth cylindrical poles and said fourth and first cylindrical poles, respectively.

9. A method in accordance with claim 8, wherein said shoring panels are connected to said cylindrical poles by a hollow cylinder having an inside diameter substantially corresponding to an outside diameter of said cylindrical poles, said hollow cylinder connected to at least one vertical edge of each said shoring panels and extending from one of an upper and lower corner of said vertically oriented shoring panels to about a midpoint of said at least one vertical edge.

10. A method in accordance with claim 5, wherein said cylindrical poles and said shoring panels are installed and assembled in said excavation from outside of said excavation.

11. An excavation shoring system comprising:

four vertical, cylindrical poles arranged to constitute corners of a rectangle;

a base element connected to a lower end of each said pole;

at least one vertically oriented shoring panel corresponding to each side of said rectangle, a first pair of said shoring panels disposed on adjacent said sides of said rectangle having a first end rotatably connected to a first of said poles, a second pair of said shoring panels disposed on other adjacent said sides of said rectangle having a second end rotatably connected with a second of said poles diagonally opposed to said first of said poles, said shoring panels oriented to form four vertical walls of said rectangle, and each of said shoring panels having an opposite movable end, said first and second poles constituting a first pair of diagonally opposed said poles; and securement means for securing said opposite movable end of each said shoring panel to a second pair of diagonally opposed said poles, said securement means comprising at least two vertically oriented, U-shaped channel assemblies comprising two U-shaped channels disposed at right angles to each other connected to said second pair of diagonally opposed said poles, said U-shaped channels having a channel width substantially corresponding to a thickness of said shoring panels and oriented to receive said opposite movable end of each said shoring panel.

12. An excavation shoring system in accordance with claim 11, wherein said shoring panel comprises a hollow cylindrical element having an inside diameter corresponding to an outside diameter of said cylindrical poles concentrically disposed around said cylindrical poles, said hollow cylindrical element connected to said one end of said shoring panel and extending along said one end from a corner of said shoring panel to about a midpoint of a length of said one end.

13. An excavation shoring system in accordance with claim 12 further comprising a plurality of vertically oriented additional shoring panels having one of said hollow cylindrical elements connected at each end of said additional shoring panels and extending along each said end from said corner of said panel to about said midpoint of said length of each said end.

14. An excavation shoring system in accordance with claim 11, wherein said shoring panels are constructed of a substantially planar honeycomb structure sandwiched between two substantially planar, solid layers of a material suitable for use in an excavation shoring.

* * * * *